United States Patent [19]

Sadoya

[11] Patent Number: 4,626,731

[45] Date of Patent: Dec. 2, 1986

[54] PIEZOELECTRIC GAS-LIGHTER

[75] Inventor: Hisayoshi Sadoya, Tokyo, Japan

[73] Assignee: TDK Corporation, Tokyo, Japan

[21] Appl. No.: 798,110

[22] Filed: Nov. 14, 1985

[30] Foreign Application Priority Data

| | | | |
|---|---|---|---|
| Nov. 16, 1984 | [JP] | Japan | 59-243053 |
| Nov. 16, 1984 | [JP] | Japan | 59-174481[U] |
| Nov. 16, 1984 | [JP] | Japan | 59-174482[U] |
| Nov. 16, 1984 | [JP] | Japan | 59-174483[U] |
| May 28, 1985 | [JP] | Japan | 60-80683[U] |

[51] Int. Cl.[4] ..... H01L 41/08

[52] U.S. Cl. ..... 310/339; 361/260

[58] Field of Search ..... 310/338, 339; 361/260

[56] References Cited

U.S. PATENT DOCUMENTS

| | | | |
|---|---|---|---|
| 3,295,024 | 12/1966 | Newman | 310/339 X |
| 3,344,314 | 9/1967 | Koontz | 310/339 X |
| 3,986,061 | 10/1976 | Suzuki et al. | 310/339 |
| 4,485,324 | 11/1984 | Berlincourt et al. | 310/339 |

*Primary Examiner*—Mark O. Budd

[57] ABSTRACT

This type of the piezoelectric gas-lighter is provided with a high-tension generator, in which gas lighter a sparking gap is kept constant by fixing a front end portion of a sparking nozzle adapted for sparking an electric energy produced in such high-tension generator, even when such high-tension generator is moved up and down in a sparking action of the lighter. Further, in this type of the gas-lighter, an electric mechanism which constitutes an earth terminal required for conducting the sparking action of the electric energy is integrally formed with constituent parts of such high-tension generator, while the earth terminal is electrically connected with a gas nozzle through a valve lever.

8 Claims, 20 Drawing Figures

PIEZOELECTRIC GAS-LIGHTER

BACKGROUND OF THE INVENTION

1. Field of the Invention

The present invention relates to an improvement of a piezoelectric gas-lighter provided with a high-tension generator having a piezoelectric element, in which gas-lighter the high-tension generator is reciprocally moved up and down while its piezoelectric element is hit to generate a high voltage which is discharged from a sparking nozzle in a sparking manner so that a fuel gas ejacted from a gas nozzle is ignited by such sparking action.

2. Description of the Prior Art

In general, as shown in FIGS. 1 and 2, a piezoelectric gas-lighter is provided with a high-tension generator incorporated therein. The high-tension generator is constructed as follows: namely, in such high-tension generator, a head pin 2 and a piezoelectric element 3 are disposed in an inside of a unit case 1 in an insertion manner and fixed therein by a seat metal 4 which is press-fitted in a terminal portion of the unit case 1. Thus constructed unit case 1 is fixed in an outer case 5 in an insertion manner, while an impacting hammer 8 is received inside an inner case 6 through an action spring 7, which inner case 6 is inserted into a bore of the outer case 5 through a return spring 9, movably up and down.

In the above construction of the conventional piezoelectric gas-lighter, the impacting hammer 8 is provided with a guide pin 8*a* projecting from its side wall. The guide pin 8*a* is disposed in an insertion manner in both of a substantially diamond-shaped window 6*a* formed in a side wall of the inner case 6 and a substantially L-shaped window 5*a* formed in the outer case 5. In the igniting operation of the piezoelectric gas-lighter, such guide pin 8*a* of the impacting hammer 8 is depressed by a user's finger against a resililent force of the return spring 9 through the outer case 5. When the thus depressed guide pin 8*a* of the impacting hammer 8 reaches a substantially middle position of the inner case 6, such guide pin 8*a* of the impacting hammer 8 is slightly urged laterally by a lower oblique edge 6*b* of the substantially diamond-shaped window 6*a*, which oblique edge 6*a* is directed to a lower edge of the same window 6*a*, so that such guide pin 8*a* of the impacting hammer 8 is disengaged from an engaging portion 5*b* of the substantially L-shaped window 5*a* to be suddenly lifted by the action spring 7 along a longitudinal edge portion of the latter window 5*a*, so that the head pin 2 disposed over the impacting hammer 8 is hit by the impacting hammer 8 to give an impact to the piezoelectric element 3.

Further, in such high-tension generator, though it is not especially shown in FIGS. 1 and 2, the sparking nozzle projecting laterally from the unit case 1 and a valve lever for opening/closing a gas valve by moving the ejection nozzle of the fuel gas up and down are electrically connected to a plus and a minus poles of the piezoelectric element 3, respectively, so that a sparking action is conducted between the sparking nozzle and the gas nozzle when the valve lever lifts the gas nozzle to open a gas conduit.

Hitherto, in such type of the piezoelectric gas-lighter, as shown in FIG. 3, the sparking nozzle 11 is directly fixed to a main body of the high-tension generator 10 so that the sparking nozzle 11 is slided downward together with the main body of the high-tension generator 10 when such generator 10 is reciprocally moved, whereby, when the impact is given to the piezoelectric element of the high-tension generator 10, the sparking nozzle is moved to a position in the vicinity of the gas nozzle 12 to conduct the sparking action through which the ejected gas from the gas nozzle 12 is ignited.

In another conventional type of the piezoelectric gas-lighter, as shown in FIG. 4, a contacting element 13*a* is provided in the high-tension generator 10 in projecting manner, while another contacting element 13*b* to be electrically connected to the above contacting element 13*a* of the high-tension generator 10 and the sparking nozzle 11 are fixed to an insulated pole-holder portion 14 in the vicinity of the gas nozzle 12. In action, when the contacting element 13*a* of the high-tension generator 10 is brought into an electrical contact with the another contacting element 13*b* of the sparking nozzle 11, a sparking action is conducted between the sparking nozzle 11 and the gas nozzle 12 so that the ejected gas from the gas nozzle 12 is ignited through such sparking action.

Of these conventional piezoelectric gas-lighters, the former gas-lighter is disadvantageous in that: a time when the impact is given to the piezoelectric element according to the reciprocal movement of the high-tension generator 10 is not fixed so that a distance between the sparking nozzle 11 and the gas nozzle 12 in which distance the sparking action is conducted varies to impair a steady sparking action therebetween. On the other hand, the latter gas-lighter is disadvantageous in that: an additional sparking gap exists between the contacting element 13*a* of the high-tension generator 10 and the another contacting element 13*b* of the sparking nozzle 11 so that the electrical energy to be discharged in sparking manner is decreased by the existence of such additional sparking gap. Consequently, in any of the conventional piezoelectric gaslighters, it is not possible to obtain a steady igniting condition. Particularly, in the latter gas-lighter, in addition to the sparking nozzle 11 and the high-tension generator 10, it is necessary to provide additionally the contacting elements 13*a*, 13*b* which increase the number of components of the gas-lighter and make their assembling operation cumbersome so that the production cost of the gas-lighers are increased. These are inherent in the conventional piezoelectric gas-lighters.

Further, hitherto, as shown in FIGS. 3 and 4, in the conventional piezoelectric gas-lighter, the following mechanism is employed as an electrical mechanism for conducting an electrical discharge in sparking manner. The electrical mechanism will be described hereinafter with reference to FIG. 3. In the electrical mechanism, the piezoelectric element incorporated in the high-tension generator is connected in its one end to an axle end of the sparking nozzle 11 which is disposed in other case in an insertion manner, while, under such sparking nozzle 11, an electrical pole-plate 15 connected to the other end of the piezoelectric element is projected from the side wall of the outer case, through which pole-plate 15 the valve lever 16 of the gas nozzle 12 is received, which valve lever 16 is depressed through a step portion 18 of the outer case which is depressed according to the pushing operation of the high-tension generator 10, so that the valve lever 16 is rotatably inclined to make it possible to connect its lower end with a connecting plate 17 which projects from the outer case, which valve lever 16 also lifts the gas nozzle 12 to open the gas conduit. At this time, the pole-plate 15 contacts with the connecting plate 17 to be electrically connected to the valve lever 16, whereby a front end of the sparking nozzle 11 forms a plus pole, while a front end of the gas nozzle 12 forms a minus pole. The above is a conventional construction of such electrical mechanism.

However, the above conventional electrical mechanism is disadvantageous in that the earth pole side components are too many in their number to cause a considerably complex construction thereof and to increase its production cost. In addition to the above disadvantages, the conventional electrical mechanism is disadvantageous also in the following points: namely, since metal plates such as the pole-plate 15 and the connecting plate 17 are partially embedded in the outer case which is not electrically conductive, there is a fear that the pole-plate 15 and the connecting plate 17 lose their steady mounting conditions to cause their damages and/or dropping after several uses.

SUMMARY OF THE INVENTION

It is an object of the present invention to provide a piezoelectric gas-lighter which eliminates an electrical energy loss and obtaines a steady ignition condition by keeping a front end of a sparking nozzle in a predetermined position when an igniting action thereof is conducted, which sparking nozzle projects from a high-tension generator moved reciprocally up and down.

It is another object of the present invention to provide a piezoelectric gas-lighter which enables its electrical mechanism to be constructed of less number of components to make it possible to produce the piezoelectric gas-lighter at a low cost, which electrical mechanism is adapted for conducting an electrical discharge in sparking manner.

It is further another object of the present invention to provide a piezoelectric gas-lighter an inner mechanism of which is durable.

BRIEF DESCRIPTION OF THE DRAWINGS

Other objects and advantages of the present invention will be clarified from the following description with reference to the accompanying drawings in which.

DESCRIPTION OF THE PREFERRED EMBODIMENTS

Figure 1:
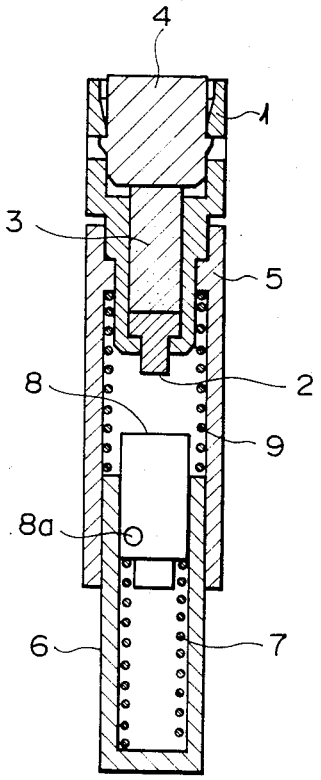
PRIOR ART FIG. 1
FIG. 1 is a longitudinal sectional view of the high-tension generator incorporated in the conventional piezoelectric gas-lighter.
Figure 2:
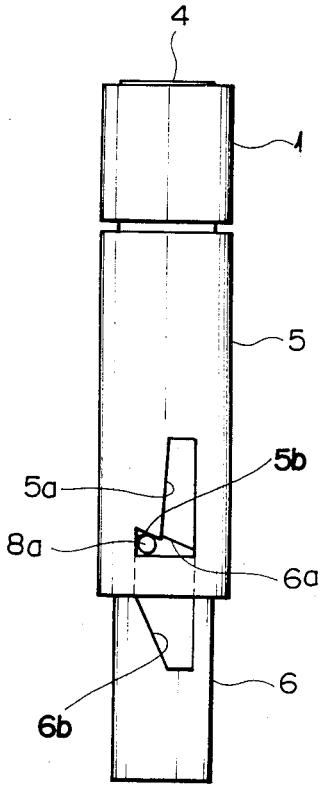
PRIOR ART FIG. 2
FIG. 2 is an outer view of the high-tension generator shown in FIG. 1.
Figure 3:
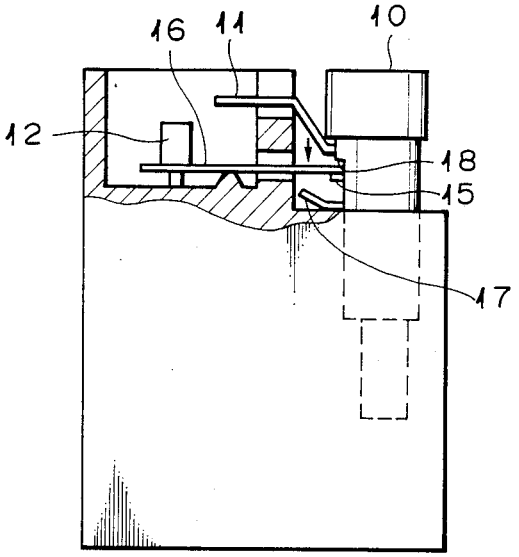
PRIOR ART FIG. 3
FIG. 3 is a partially broken side view of the conventional piezoelectric gas-lighter.
Figure 4:
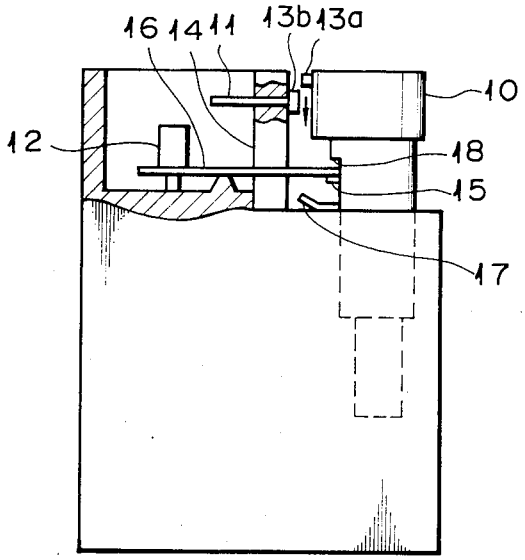
PRIOR ART FIG. 4
FIG. 4 is a partially broken side view of another conventional piezoelectric gas-lighter.
Figure 5:
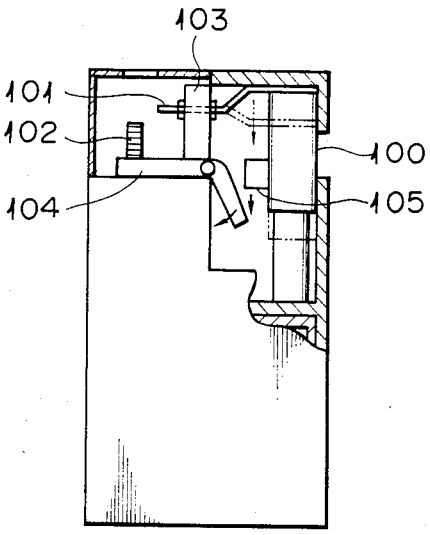
FIG. 5 is a partially broken side view of an improved portion of a sparking nozzle, which improved portion constitutes a base of a piezoelectric gas-lighter of the present invention.

In a piezoelectric gas-lighter shown in FIG. 5, there is employed a high-tension generator 100 in which a piezoelectric element is incorporated, an electrical energy generated in the high-tension generator 100 is discharged from a sparking nozzle 101 in sparking manner so that an ejected gas from a gas nozzle 102 is ignited through such sparking action. Such sparking nozzle 101 is electrically conductive and is made of resilient material to be deformable, which sparking nozzle 101 may be made of a soft metal plate such as phosphorus bronze plate or the like having a thickness of about from 40 to 60 μm or may be made of a flexible plate in which an electrode is printed on a flexible film. A terminal of the sparking nozzle 101 is connected to an end of a piezoelectric element incorporated in the high-tension generator 100, while the other terminal of the sparking nozzle 101 is so disposed that it projects to provide a predetermined sparking gap in the vicinity of the gas nozzle 102. Such projecting terminal of the sparking nozzle 101 is fixed to a thick wall portion of a holder frame 103 which is electrically non-conductive, so as to provide the predetermined sparking gap relative to the gas nozzle 102 which is supported by a valve lever 104 so as to be movable up and down, which valve nozzle 104 is always urged counterclockwise by a spring (not shown) to close a gas conduit of the gas nozzle 102. When the valve lever 104 is depressed by an electrical mechanism portion 105 of the high-tension generator 100, which electrical mechanism 105 is described in detail later, the valve lever 104 is moved against the resilient force of the spring so that the gas conduit of the gas nozzle 102 is opened through such movement of the valve lever 104.

In the piezoelectric gas-lighter having the above construction, when the high-tension generator 100 is depressed in its axial head portion by the user's finger, the high-tension generator 100 is moved downward against the resilient force of a return spring received therein, in reciprocating manner. In this depressing acton of the high-tension generator 100, the sparking nozzle 101 follows the high-tension generator 100 as shown in dotted line of FIG. 5, because the sparking nozzle 101 is made of a resilient metal material as a whole. Then, when the high-tension generator 100 is depressed to a predetermined position in reciprocating manner while its electrical mechanism 105 abuts against the valve lever 104 so that the gas conduit of the gas nozzle 102 is opened, a sparking is generated from the sparking nozzle 101 under the effect of the impact of the piezoelectric element incorporated in the high-tension generator 100 so that the gas ejected from the gas nozzle 102 is ignited. Even in a time when the sparking is generated, the sparking terminal of the sparking nozzle 101 is stationarily fixed to the holder frame portion 103, so that it is possible to generate a sparking from a fixed position without impairing the sparking gap formed by slightly lifting the gas nozzle 102. After igniting the gas, when the high-tension generator 100 is released from its depressing force, the high-tension generator 100 is lifted again by the return spring which is incorporated in the high-tension generator 100, so that the sparking nozzle 101 returns to its initial position while the gas conduit of the gas nozzle 102 is closed by the valve lever 104 which is forcibly urged by the spring (not shown) to its initial position, so that the burning of the gas ceases.

According to the piezoelectric gas-lighter of the present invention described above, the following advantages are obtained: namely, it is possible to keep the sparking gap in a predetermined amount between the sparking nozzle 101 and the gas nozzle 102, and to eliminate any loss of the electrical energy generated in the high-tension generator 100 to make it possible to obtain a sure ignition of the gas since the sparking nozzle 101 is integrally formed with the high-tension generator 100, and further it is possible to simplify the assembly process of such piezoelectric gas-lighter because it is only required that the sparking nozzle 101 is provided between the high-tension generator 100 and the holder frame portion 103 in bridging manner to make it possible to produce such piezoelectric gas-lighter at a low cost.

In this piezoelectric gas-lighter, it is possible to construct the electrical mechanism as shown in FIGS. 6 to 20.

Figure 6:
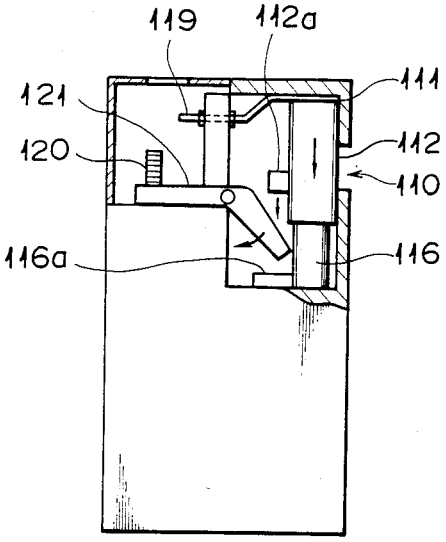
FIGS. 6 to 20 are views showing improved portions of an electrical mechanism of the piezoelectric gas-lighter of the present invention.
Figure 7:
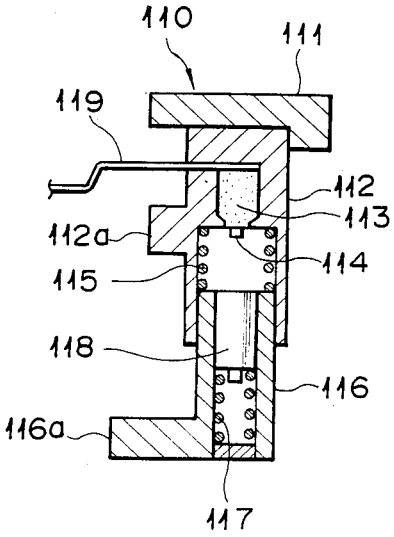

A high-tension generator 110 shown in FIGS. 6 and 7 is constructed as follows: namely, in such high-tension generator 110, a piezoelectric element 113 is incorporated in an inside of an outer case 112 which is integrally formed with a push-cap 111 and is made of an insulating resin, while an inner case 116 is disposed in a bore of the outer case 112 through a return spring 115 in an insertion manner in a side in which a head pin 114 of the piezoelectric element 113 projects, in which inner case 116 an impact hammer 118 is received through an action spring 117 which supports the impact hammer 118. In the outer case 112, there is provided a sparking nozzle 119 which projects outward from the outer case 112 and is connected with an end of the piezoelectric element 113 in its one end, which outer case is electrically non-conductive, which sparking nozzle 119 is directed to a gas nozzle 120 to form a plus electrode when a sparking is produced from its nozzle tip. The gas nozzle 120 is so constructed that it opens a gas conduit thereof when it is slightly lifted by a valve lever 121. In order to make it possible to lift the gas nozzle 120, the valve lever 121 formed into a substantially reversed V-shaped configuration is pivotally mounted on a suitable portion of the gas-lighter case in its center portion. In a free end side of the valve lever 121, a push-projection **112*a* is disposed to make it possible to abut against such free end of the valve lever 121, which push-projection 112*a* may be integrally formed with the non-conductive outer case 112 or may be independently formed of such outer case 112 so as to be mounted on the outer case 112 separately, which push-projection 112*a* inclines rotatably the valve lever 121 in an urging manner when the high-tension generator 110 is depressed reciprocally against the resilient force of the return spring 115. In the lowermost position of such depressing movement of the high-tension generator 110, in which position the valve lever 121 is inclined rotatably, a projecting portion 116*a* is disposed so as to be connected with the free end of the valve lever 121 when the valve lever 121 is inclined, which projecting portion 116*a* projects from a side wall of the inner case 116. Such projecting portion 116*a* may be integrally formed with the inner case 116 when the latter is molded with a conductive resin, while taking any configuration suitable for abutting against the free end of the valve lever 121, which projecting portion 116*a* is electrically connected to the other end of the piezoelectric element 113 through the inner case 116 to form an earth terminal when the high-tension generator 110 is depressed to hit the piezoelectric element 113 by the impact hammer 118 which is received in the inner case 116**.

Figure 8:
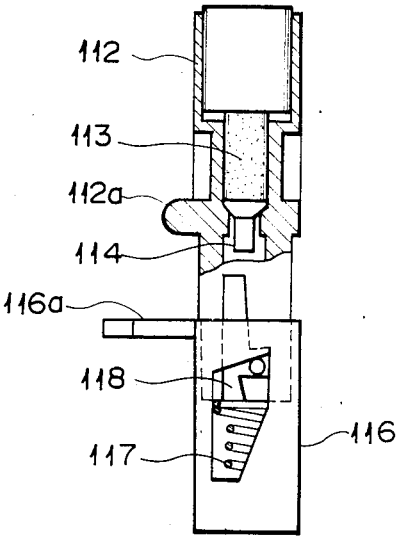

Incidentally, in the above embodiment of the present invention, there is shown the high-tension generator 110 in which the inner case 116 incorporating the impact hammer 118 therein is disposed in the bore of the outer case 112 which is made of a non-conductive resin. However, in place of this construction, as shown in FIG. 8, it is possible to dispose an axle portion of the non-conductive case 112 in the hammer incorporating case 116 in an insertion manner to construct another type of the high-tension generator 110, in which another type it is also possible to form the projecting portion **116*a* as an earth terminal in an integral manner with the hammer incorporating case 116 so as to project from such case 116 in either of the upper and lower end of the same case 116**.

In the piezoelectric gas-lighter having the above construction, in its use, when the high-tension generator 110 is depressed through its push-cap 111, the non-conductive case 112 is also depressed so that the impact hammer 118 jumps up suddenly under the effect of the resilient force of the action spring 117 to hit the head pin 114 of the piezoelectric element 113 strongly. Due to such strong hit, the piezoelectric element produces an electrical energy which is directed to the sparking nozzle 119 forming the plus electrode. On the other hand, when the non-conductive case 112 is depressed, its projection **112*a* urges the free end of the valve lever 121 to incline the latter rotatably so that the gas nozzle 120 is lifted by the valve lever 121 to open its gas conduit, while the free end of the valve lever 121 abuts against the projecting portion 116*a* of the hammer incorporating case 116. At this time, when the impact hammer 118 hits the piezoelectric element 113, the projecting portion 116*a* acts as the earth terminal to be connected to the nozzle tip of the gas nozzle 120 through the valve lever 121 to form the minus electrode, whereby a sparking is produced in the sparking nozzle 119 toward the gas nozzle 120 to ignite the fuel gas ejected from the gas nozzle 120**.

Figure 9:
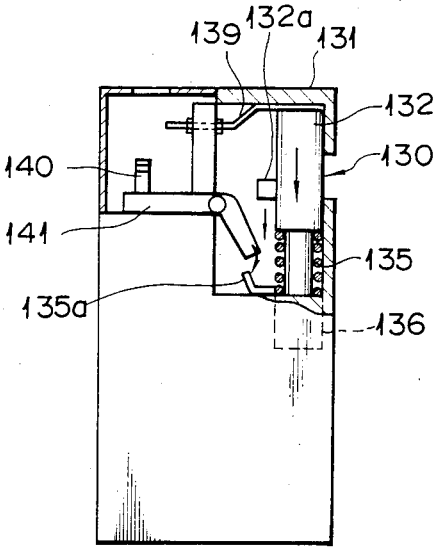
Figure 10:
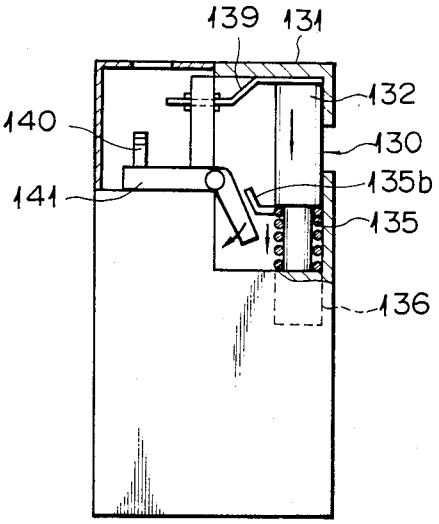
Figure 11:
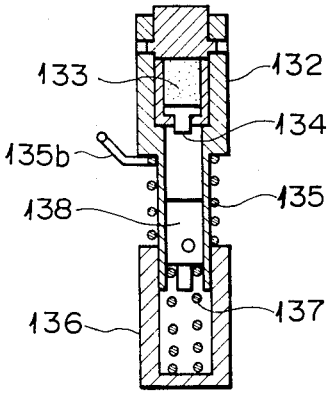

A piezoelectric gas-lighter shown in FIGS. 9 and 10 has a substantially similar construction to that of the gas-lighter shown in FIG. 6 in its essential construction. In the piezoelectric gas-lighter shown in FIGS. 9 and 10, its high-tension generator 130 is constructed as follows: namely, in the high-tension generator 130, as shown in FIG. 11, a piezoelectric element 133 is incorporated in an outer case 132 which is integrally formed with a push-cap 131 with the use of an insulating resin, and an axle portion of which outer case is disposed in a bore of an inner case 136 through a return spring 135 in an insertion manner in side in which a head pin 134 of a piezoelectric element 133 projects, in which inner case 136 there is received an impact hammer 138 which is supported by an action spring 137. A sparking nozzle 139 an end of which is connected to an end of the piezoelectric element 133 is provided in the outer case 132 to project outward therefrom, a nozzle tip of which sparking nozzle 139 is directed to a gas nozzle 140 to form a plus electrode when a sparking is produced. The gas nozzle 140 is so constructed that it opens a gas conduit thereof when it is slightly lifted by a valve lever 141. In order to make it possible to lift the gas nozzle 140, the valve lever 141 which is formed into a substantially reversed V-shaped configuration is pivotally mounted on a suitable portion of the lighter case in its central portion.

In the piezoelectric gas-lighter shown in FIG. 9, a push-element **132*a* for inclining the valve lever 141 rotatably is integrally formed with the outer case 132 in a side wall of the latter so that the push-element 132*a* abuts against a free end of the valve lever 141 when the high-tension generator 130 is depressed against the resilient force of the return spring 135 in reciprocating manner. A projecting element 135*a* which is formed out of an extension of a lower end of the return spring 135 is also provided to be connected with the free end of the valve lever 141 when such lever 141 is inclined rotatably, while also connectable electrically with the other end of the piezoelectric element 133 incorporated in the outer case 132 when it 135***a* abuts against the valve lever 141, so that a nozzle tip of the gas nozzle 140 forms an earth electrode through a contact with the valve lever 141. Such electrical connection between the other end of the piezoelectric element and the nozzle tip of the gas nozzle 140 is established when the inner case 136 is made of an electrically conductive resin to make it possible that the other end of the piezoelectric element is electrically connected with the return spring 135 through the impact hammer 138, the action spring 137 and the inner case 136 when the piezoelectric element 133 is hit by the impact hammer 138 according to the depressing action of the high-tension generator 130.

Figure 12:
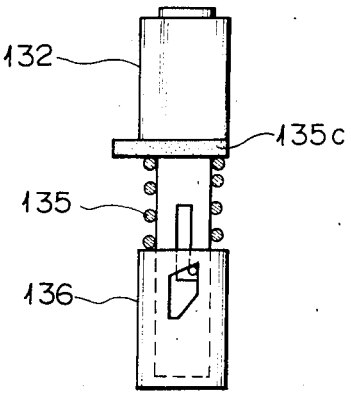

In place of the above projecting element 135*a*, as shown in FIGS. 10 and 11, an extension of an upper end 135*b* of the return spring 135 may be employed as a push-element for the valve lever 141 while it may be also employed as an earth terminal. Further, in place of these projecting elements 135*a* and 135*b*, as shown in FIG. 12, it is possible to employ a projecting segment 135*c* as the projecting elements described above, which projecting segment 135*c* is made of an electrically conductive resin and is disposed in an axial line of the outer case 132 so as to be electically connected with the return spring 135, which projecting segment 135*c* may be employed as a push-element for the valve lever 141 and/or an earth terminal as is in the case shown in FIG. 11.

In the piezoelectric gas-lighter having the above construction, when the high-tension generator 130 is depressed through the push-cap 131, the outer case 132 is depressed also, and as a result the head pin 134 of the piezoelectric element 133 is hit by the impact hammer 138 which jumps suddenly under the effect of the resilient force of the action spring 137, strongly. Through such strong hit, the piezoelectric element 133 produces an electrical energy which is directed to the sparking nozzle 139 forming the plus electrode. On the other hand, at this time, the valve lever 141 is inclined rotatably by the push-element 132*a* or the projecting elements 135*b*, 135*c* which abuts against the free end of the valve lever 141 in urging manner according to the depressing action of the outer case 132, so that the gas nozzle 140 is lifted by the valve lever 141 to open its gas conduit. As for the embodiment shown in FIG. 9, the free end of the valve lever 141 abuts against the projecting element 135*a* of the return spring 135. These projecting elements 135*a*, 135*b*, 135*c* act as the earth terminal at a time when they abut against the valve lever 141, and throuth the valve lever 141, are electrically connected to the nozzle tip of the gas nozzle 140 to make the same 140 be a minus electrode. As a result, a sparking is produced in the sparking nozzle 139 toward the gas nozzle 140 to ignite the fuel gas ejected from the gas nozzle 140.

In the piezoelectric gas-lighter as described above, after ignition of the fuel gas, when the high-tension generator is released from its depressing force, such high-tension generator returns to its initial position upward under the effect of the resilient force of the return spring, while the valve lever is released from the projecting element or the push-element to return its initial position rotatably under the effect of a tension force of a tension spring (not shown) which is mounted on an arm end of the valve lever positioning in the vicinity of the gas nozzle, so that the gas nozzle is forcibly closed.

However, in this type of the piezoelectric gas-lighter, there is a fear that the high-tension generator is impaired in its operability, because the arm end of the valve lever positioning in the vicinity of the gas nozzle must be pulled by the tension spring, and also because it is required to compress the return spring of the high-tension generator and also to pull the tension spring of the valve lever in the ignition operation of the gas-lighter thus requiring a considerably large amount of effort. Further, since the arm end of the valve lever positioning in the vicinity of the gas nozzle is positioned in an extremely restricted area, an assembling operation of the tension spring is very cumbersome.

Figure 13:
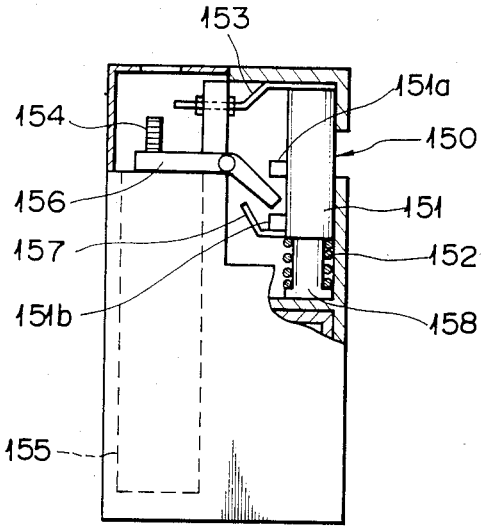

In order to eliminate these disadvantages described above, another construction of the high-tension generator 150 shown in FIG. 13 is employed, in which high-tension generator 150, two projection portions 151*a*, 151*b* are provided in an outer case 151 thereof to operate the valve lever in the following manner.

Also in this piezoelectric gas-lighter, there is provided the high-tension generator 150 in which the piezoelectric element is incorporated, which high-tension generator 150 is incorporated in the lighter case to be adapted for being reciprocally movable up and down by means of its return spring 152. The high-tension generator 150 is moved downward against the resilient force of the return spring 152 when depressed, whereby an impact is given to a piezoelectric element received in the high-tension generator 150 to produce a sparking discharge of the electrical energy from a sparking nozzle 153, so that the ejected gas from a gas nozzle 154 is ignited by such sparking. The gas nozzle 154 is so provided that it provides a predetermined sparking gap relative to the sparking nozzle 153 and is mounted on a gas tank 155 so as to project from the gas tank 155, in agreement with an axial line of which gas nozzle 154 there is disposed a valve lever 156 so as to be engaged with the gas nozzle 154. This valve lever 156 is formed by a lever arm having a substantially reversed V-shaped configuration, so that the valve lever 156 is pivotally mounted on a suitable portion of the lighter case in its central portion. In the vicinity of a free end of such valve lever 156, two projection portions 151*a*, 151*b* are vertically disposed to be able to abut against the free end of the valve lever 156, which projection portions 151*a*, 151*b* project from the outer case 151 of the high-tension generator 150 described above. Each of such projection portions 151*a*, 151*b* may be integrally formed with the outer case 151 when the outer case 151 is molded with the resin. In assembling, these projection portions 151*a*, 151*b* are disposed in an upper and lower position of the free end of the valve lever 156 so as to dispose such free end of the valve lever 156 therebetween when the high-tension generator 150 is incorporated in the lighter case, to make it possible that: when the high-tension generator 150 is depressed, the projecion portion 151*a* disposed above the free end of the valve lever 156 depresses the free end of the valve lever 156; and, when the high-tension generator 150 is lifted, the projecion portion 151*b* disposed under the free end of the valve lever 156 lifts the free end of the valve lever 156.

Figure 14:
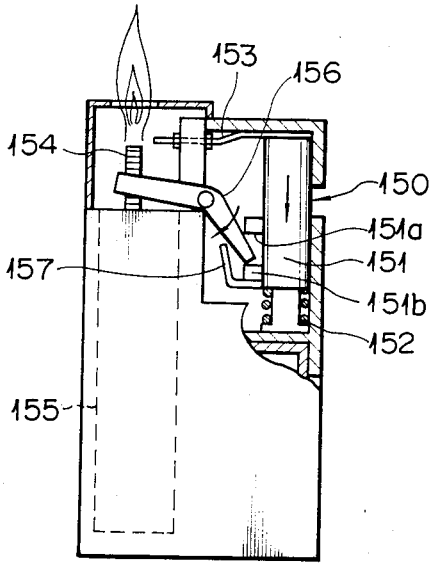
Figure 15:
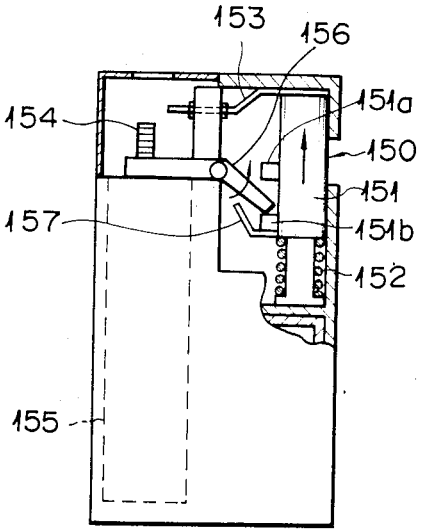

In the piezoelectric gas-lighter having the above construction, as shown in FIG. 14, when the high-tension generator 150 is depressed to conduct an electrical discharge of the electrical energy produced in the piezoelectric element in a sparking manner from the sparking nozzle 153, the projection portion 151*a* of the outer case 151 abuts against the free end of the valve lever 156 to lift the gas nozzle 154 so that the fuel gas is ejected from the thus lifted gas nozzle 154. Consequently, the thus ejected gas is ignited by the sparking action between the sparking nozzle 153 and the gas nozzle 154. After completion of the ignition of the fuel gas ejected from the gas nozzle 154, when the high-tension generator 150 is released from its depressing force, as shown in FIG. 15, the return spring 152 which has been compressed is released from its compression condition to lift the high-tension generator 150. At this time, since the projection portion 151*b* projecting from the outer case 151 pushes the free end of the valve lever 156 upward, the other end of the valve lever 156 depresses the gas nozzle 154 to its initial position so that the gas conduit of the gas nozzle 154 is closed.

Incidentally, in the above embodiment of the present invention, it is also possible to employ the upper projection portion 151*a* as an earth terminal. Further, it is also possible to employ as such earth terminal the extension 157 of the return spring 152 in the vicinity of the lower projection portion 151*b* or also possible to employ as such earth terminal a nail-like portion projecting from a case 158 in which the impact hammer of the high-tension generator 150 is incorporated, which case 158 is made of a conductive resin, and both of which extension 157 and nail-like portion are constructed to be brought into an electrical contact with the valve lever 156 so as to be able to act such earth terminals.

Further, although it has been described in the above embodiments of the gas-lighter of the present invention that the projecting element and the projection portion both of which are provided outside the high-tension generator of such gas-lighter act as the earth terminals, it is also possible as shown in other embodiments of the gas-lighter of the present invention shown in FIGS. 16 to 20 that the earth terminal may be provided without providing such projection portion and the like in the high-tension generator of the gas-lighter, as follows.

In such other embodiment of the gas-lighter of the present invention, there is provided a high-tension generator 160 which is so constructed that: an axle portion of an inner case 162 is disposed in a sleeve portion of an outer case 163 through a return spring 161 in an insertion manner so that each mechanism portions are received in such cases. The inner case 162 is formed into a sleeve-like configuration, in which inner case 162 is received an impact hammer 165 which is supported by an action spring 164 so as to be able to jump up resiliently as shown in a sectional view of FIG. 17 which is taken along the line A—A of FIG. 16. The outer case 163 is made of an insulating resin and formed into a sleeve-like configuration, in which outer case 163 is incorporated a piezoelectric element 167 which is fixed to the outer case 163 through a receiving metal 166, in which outer case 163 the return spring 161 described above is also received. The piezoelectric element 167 generates a high voltage upon receipt of an impact from the impact hammer 165 which is guided to be able to move violently through its left and right guide pins 165*a* and 165*b* which are slidably disposed in both of: a substantially diamond-shaped window 162*a* formed in the inner case 162; and a substantially L-shaped window 163*a* formed in the outer case 163 in an insertion manner. Further, the outer case 163 is provided with: a step portion 168 which is formed by partially cutting a side wall of the outer case 163; and a longitudinally elongated opening 169 through which a coiling portion of the return spring 161 received in the outer case 163 appears.

Figure 19:
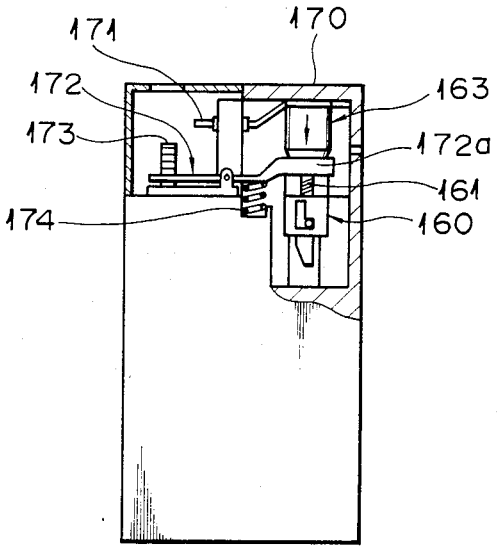
Figure 20:
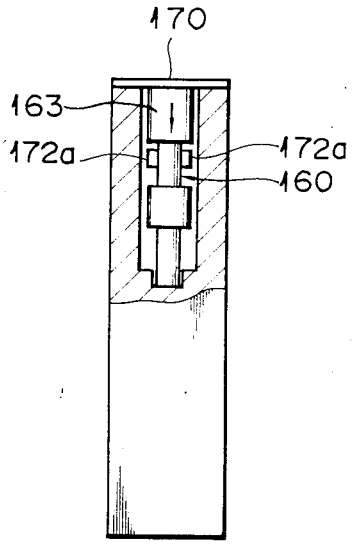

As shown in FIGS. 19 and 20, such high-tension generator 160 is so mounted on the gas-lighter that in the lighter case it may move reciprocally through the user's finger operation of a push-cap 170 which is fixed to a head portion of the outer case 163. From a side wall of the head portion of the outer case 163 projects a sparking nozzle 171 which is connected to the piezoelectric element 167 inside the outer case 163. An arm end 172*a* of a valve lever 172 is inserted into the cut portion of the outer case 163. The valve lever 172 is pivotally mounted on a suitable portion of the lighter case in its central portion, while, in its front end, being in agreement with an axial line of a gas nozzle 173 so that it may move the gas nozzle 173 up and down under the effect of its lever-action to cause a gas conduit to be opened/closed. Further, the arm end 172*a* of the valve lever 172 is disposed to be able to abut against the step portion 168 of the outer case 163, while disposed also to be able to abut against the coil portion of the return spring 161, which coil portion appears through the opening 169 of the outer case 163. The inner case 162 with which the coil end of the return spring 161 is brought into contact is made of an electrically conductive resin, so that it is possible to establish an electrical connection between the valve lever 172 and the other end of the piezoelectric element 167 through the impact hammer 165 and the action spring 164 in addition to another electrical connection established between the coil porion of the return spring 161 and the valve lever 172, which return spring 161 forms a part of the earth electrode connection.

In the piezoelectric gas-lighter having the above construction, when the outer case 163 is depressed through its operational cap 170 against the resilient force of the return spring 161, the impact hammer 165 is moved downward through its guide pins 165*a*, 165*b* which are depressed through the window 163*a* of the outer case 163, while the action spring 164 is compressed by the thus moved impact hammer 165, as is in the cases described in the above. When the guide pins 165*a*, 165*b* are disengaged from the window 163*a* of the outer case 163 by being guided through the window 162*a* of the inner case 162 from the horizontal edge portion of the window 163*a* to the vertical edge portion of the same, the impact hammer 165 is violently moved upward under the effect of the resilient force of the action spring 164 to hit strongly the piezoelectric element 167 incorporated in the outer case 163, whereby the piezoelectric element 167 generates a high voltage which is discharged from the sparking nozzle 171 as an electrical energy in an sparking manner.

In synchronization with the above sparking action, the arm end 172*a* of the valve lever 172 abuts against the step portion 168 of the outer case 163 to lift the gas nozzle 173 with the use of its pivotally mounted central portion acting as its fulcrum. Further, the arm end 172*a* of the valve lever 172 is brought into a slidable contact with the coil portion of the return spring 161 appearing through the opening 169 of the outer case 163 while it is moved downward in a rotatable manner along the cut portion of the outer case 163. Through such slidable contact between the the arm end 172*a* of the valve lever 172 and the coil portion of the return spring 161, the electrical connection between the other end of the piezoelectric element 167 and the valve lever 172 is established in addition to another electrical connection through the conductive inner case 162, the action spring 164, the impact hammer 165 hitting the other end of the piezoelectric element 167 and the other end of the piezoelectric element 167, whereby the sparking nozzle 171 is connected to the plus electrode of the high-tension generator 160 while the gas nozzle 173 is connected to the minus electrode of the high-tension generator 160 through the valve lever 172, so that the sparking action is produced between the sparking nozzle 171 and the gas nozzle 173. At a time when the sparking action is conducted, the gas conduit of the gas nozzle 173 is opened by the valve lever 172 lifting the gas nozzle 173. Consequently, the gas ejected from such gas conduit of the gas nozzle 173 is ignited by the above sparking action.

After completion of such ignition action, when the high-tension generator 160 is released from the user's finger depression, the outer case 163 returns to its initial position under the effect of the resilient force of the return spring 161. At this time, the guide pins 165*a*, 165*b* of the impact hammer 165 are guided through the window 162*a* of the inner case 162 to be engaged with the horizontal edge portion of the window 163*a* of the outer case 163. On the other hand, the valve lever 172 is released from the step portion 168 of the outer case 163 to move the gas nozzle 173 downward with the use of the resilient force of the compression spring 174 disposed in the vicinity of the arm end 172*a* of the valve lever 172 or the resilient force of another spring (not shown) disposed in agreement with the axial line of the gas nozzle 173, so that the valve lever 172 returns to its initial position.

Figure 16:
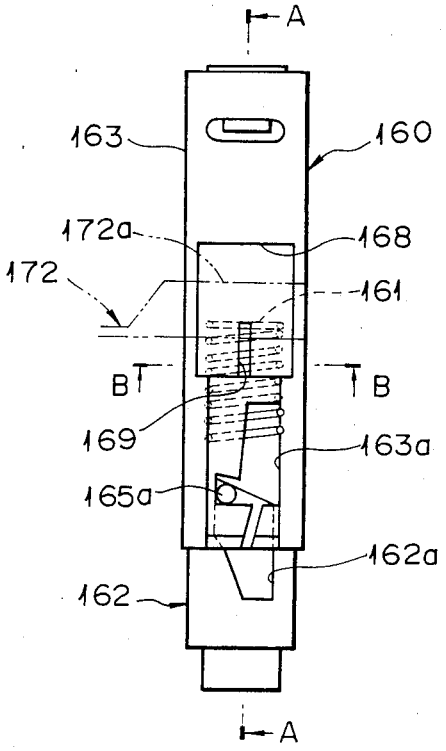
Figure 17:
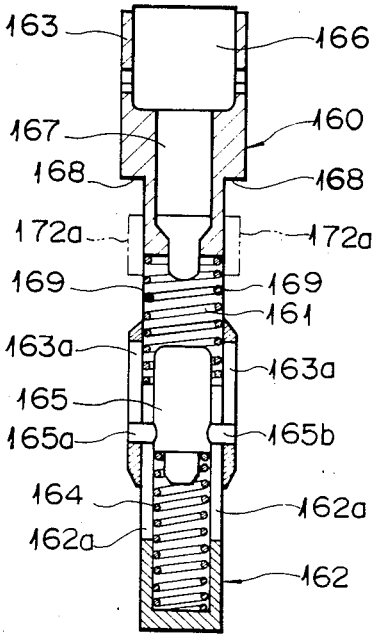
Figure 18:
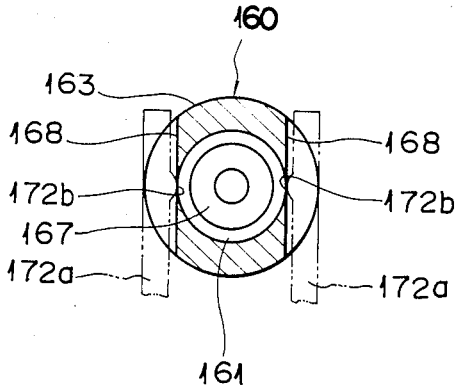

Incidentally, in the above embodiment, in order to establish a sure electical contact between the arm end 172*a* of the valve lever 172 and the coil portion of the return spring 161 appearing through the opening 169 of the outer case 163, as shown in a sectional view of FIG. 18 which view is taken along the line B—B of FIG. 16, it is possible to form a bulging portion 172*b* in a part of the arm end 172*a* of the valve lever 172, which part is opposite to the opening 169 of the outer case 163.

In the piezoelectric gas-lighter of the present invention, since the electrical mechanism is constructed of the components which are integrally formed with the components constituting the high-tension generator, the piezoelectric gas-lighter of the present invention is excellent in durability and simple in construction of its mechanism to make it possible to be procuded at low cost, in addition to its sure ignition action.

Although particular preferred embodiments of the present invention have been described in detail in the above for illustrative purposes, it will be recognized that variations or modifications of the piezoelectric gas-lighter of the present invention described in the above, including the rearrangement of its parts, lie within the scope of the present invention.

What is claimed is:

1. In a piezoelectric gas-lighter comprising a high-tension generator (100, 110, 130, 150, 160) having an inner and outer cases (112, 116, 132, 136, 151, 158, 163, 162) which are moved up and down reciprocally by a return spring (115, 135, 152, 161), in which cases are received: a piezoelectric element (113, 133, 167); and an impact hammer (118, 138, 165) supported by an action spring, said gas-lighter being operated in that: when said high-tension generator is depressed to cause said impact hammer to hit said piezoelectric element strongly, said piezoelectric element produces a high voltage which is discharged from a sparking nozzle (101, 119, 139, 153, 171) in a sparking manner, while a valve lever (104, 121, 141, 156, 172) lifts a gas nozzle (102, 120, 140, 154, 173) to cause said gas nozzle to eject a fuel gas to be ignited, the improvement resides in that:

said sparking nozzle (101, 119, 139, 153, 171) is made of a resilient material and is mounted on said high-tension generator (100, 110, 130, 150, 160), a nozzle tip of which sparking nozzle is fixed to an insulating holder frame portion (103) in the vicinity of said gas nozzle (102, 120, 140, 154, 173), whereby at a time when said high-tension generator (100, 110, 130, 150, 160) is moved reciprocally said sparking nozzle (101, 119, 139, 153, 171) can follow said high-tension generator while being resiliently deformed to make it possible to discharge an electrical energy from a front end of said sparking nozzle toward said gas nozzle.

2. The piezoelectric gas-lighter as set forth in claim 1, wherein:

said sparking nozzle (102, 120, 140, 154, 173) is made of soft metal material such as phosphorus bronze or the like.

3. The piezoelectric gas-lighter as set forth in claim 1, wherein:

said case (116) in which said impact hammer (118) of said high-tension (110) is incorporated and a projection portion (116*a*) projecting from a side wall of said case (116) are integrally formed with each other with the use of an electrically conductive resin, which case (116) is electrically connected to said piezoelectric element (113) which is incorporated in an electrically non-conductive case (112) of said high-tension generator (110); said projection portion (116*a*) of said case (116) is disposed to be able to contact a valve lever (121) of said gas nozzle (120) when said high-tension generator (110) is depressed, so that through said contact said projection portion (116*a*) of said case (116) in which said impact hammer (118) is incorporated forms an earth terminal.

4. The piezoelectric gas-lighter as set forth in claim 1, wherein:

a projecting element (135*a*, 135*b*, 135*c*) projects as a continuation of said return spring (135) which is adapted for moving said high-tension generator (130) up and down reciprocally, which projecting elmenet is disposed to be able to abut against said valve lever (141) of said gas nozzle (140) and also to be electrically connected to said piezoelectric element (133) incorporated in said high-tension generator (130) when said high-tension generator (130) is depressed.

5. The piezoelectric gas-lighter as set forth in claim 4, wherein:

said projecting element (135*a*, 135*b*) is formed of an extension of an end of said return spring (135).

6. The piezoelectric gas-lighter as set forth in claim 4, wherein:

said projecting element (135*c*) is formed of a tab segment made of an electrically conductive resin, which tab segment is electrically connected with an end of said return spring (135).

7. The piezoelectric gas-lighter as set forth in claim 1, wherein:

two projection portions (151*a*, 151*b*) are vertically provided in an outer case (151) of said high-tension generator (150) so as to be able to abut against said valve lever (156) to make it possible to rotate said valve lever (156) clockwise or counterclockwise when said high-tension generator (150) is moved reciprocally by said return spring (152).

8. The piezoelectric gas-lighter as set forth in claim 1, wherein:

in a sleeve-like side wall of said outer case (163) in which an axle portion of said inner case (162) is inserted through said return spring (161) of said high-tension generator (160), there are provided: a step portion (168) which is formed by partially cutting said sleeve-like all of said outer case (163); and an opening (169) through which a coil portion of said return spring (161) appears, in which step portion (168) an arm end of said valve lever (172) is inserted to be depressed through said step portion (168) of said outer case (163), which valve lever is adapted for opening/closing said gas nozzle (173), said arm end (172*a*) of said valve lever (172) being adapted to contact said coil portion of said return spring (161) appearing through said opening (169) of said outer case (163), whereby an earth electrode connected with said gas nozzle (173) is formed.

* * * * *